United States Patent [19]

Bodkins

[11] Patent Number: 5,009,334

[45] Date of Patent: Apr. 23, 1991

[54] ANTI-PILFERAGE FIXTURE

[75] Inventor: Stanley H. Bodkins, Sharon, Mass.

[73] Assignee: The Gillette Company, Boston, Mass.

[21] Appl. No.: 409,252

[22] Filed: Sep. 19, 1989

[51] Int. Cl.[5] ..... A47F 7/00

[52] U.S. Cl. ..... 211/54.1; 211/57.1; 248/220.4

[58] Field of Search ..... 211/54.1, 57.1, 59.1, 211/181, 59.3, 106; 248/220.4, 221.1, 551

[56] References Cited

U.S. PATENT DOCUMENTS

| | | | |
|---|---|---|---|
| 2,698,690 | 1/1955 | Rubenstein | 211/106 |
| 2,802,576 | 8/1957 | Kelling | 211/59 |
| 3,481,481 | 12/1969 | Witek et al. | 248/220.4 X |
| 3,501,015 | 3/1970 | Behles | 248/220.4 X |
| 3,785,501 | 1/1974 | Canning | 211/7 |
| 3,815,756 | 6/1974 | Cox | 211/57 |
| 3,934,727 | 1/1976 | Brefka | 211/7 |
| 4,289,242 | 9/1981 | Kenyon | 211/59.1 X |
| 4,474,300 | 10/1984 | Entis | 211/57 |
| 4,475,658 | 10/1984 | Roberts | 211/54.1 |
| 4,591,057 | 5/1986 | Garfinkle | 211/59.1 |
| 4,606,466 | 8/1986 | Fredrickson | 211/59.1 |
| 4,742,923 | 5/1988 | Calvert | 248/220.4 X |
| 4,775,054 | 10/1988 | Dixon | 211/57.1 |
| 4,783,033 | 11/1988 | Valiulis | 248/220.4 |
| 4,801,116 | 1/1989 | Blankenship | 248/220.4 |
| 4,865,205 | 9/1989 | Thorneburg et al | 211/59.1 |

*Primary Examiner*—Sarah A. Lechok

*Attorney, Agent, or Firm*—Aubrey C. Brine; Owen J. Meegan

[57] ABSTRACT

A display device comprising a peg board and a rod extending therefrom for supporting a plurality of aligned items is provided with an anti-pilferage fixture. The anti-pilferage fixture is formed of a cage-like structure supported from the peg board and disposed about the aligned items, which inhibits movement of no more than a predetermined number of items outwardly from the free end of the rod in a single movement, thereby providing a deterrent to the pilfering of a large number of items from the display.

11 Claims, 1 Drawing Sheet

ANTI-PILFERAGE FIXTURE

BACKGROUND OF THE INVENTION

The present invention relates to merchandizing displays in general and more particularly to an anti-pilferage display system which is intended to inhibit large scale pilferage of items contained in individual packages which are supported in alignment as from a peg board or other support.

In the field of merchandising, a common method of displaying items which are the product of shrink packaging, or other method of attachment to a display card is that of supporting the items from a single rod or a plurality of rods extending from a peg board or other wall surface. The items may have a single hole or plurality of holes punched in the retaining card and are aligned one behind the other by inserting a rod through the hole, or holes in the card, producing a display wherein the item and its packaging information are readily viewable by the customer.

In such merchandising displays as described above, the items are readily removed from a supporting rod by moving the opening in the card past the end of the rod allowing the customer a simple means of obtaining a desired item without the aid of store personnel.

In displaying a large number of items in the manner previously discussed, a problem exists in protecting the displayed merchandise from theft, even when the display is located in a high traffic area of the store. While the pilferage of one or perhaps two items would be of concern, recently retail outlets have been experiencing large scale pilferage of relatively expensive items from display systems of the type described above. With a plurality of items supported from a rod as is the common method of display, a large number of items, or the entire row of items may be quickly moved forward from the rod end in a single motion while attracting little attention from store personnel, or customers nearby.

While solutions to this problem have included the employment of means for locking the rod end, such devices require obtaining the attention and aid of store personnel in order to purchase an item, which is often time consuming and therefore may discourage purchase of an item from a display containing such locking means.

It is therefore an object of the present invention to provide an anti-pilferage display device which allows the customer to remove only one, or any other predetermined number of items from the display device in a single motion, to prevent pilfering of a large number of items from the display.

Another object of the invention is to provide an antipilferage display device as set forth above which allows the customer to remove items from the device without the aid of store personnel.

A further object of the invention is to provide an antipilferage fixture to be employed with those display devices having a peg board or other support with a rod extending outwardly therefrom, which fixture is effective to inhibit removal of more than a predetermined number of items from the display with a single motion.

Yet another object of the invention is to provide an antipilferage fixture of the type described which is simple to manufacture and easily assembled to a peg board commonly used in such display devices.

SUMMARY OF THE INVENTION

The above objects and other objects which will become apparent as the description proceeds are accomplished by providing an anti-pilferage display device for use with a plurality of items to be displayed in a row, which comprises wall means having at least one rod extending therefrom for supporting the items in alignment for movement along the rod toward the rod free end. Means is provided in spaced relation with the rod free end for inhibiting movement of no more than a predetermined number of the aligned items outwardly from the rod free end, and means are disposed along the length of the rod for inhibiting lateral movement of an item supported on the rod free end.

The display may further include means extending along the length of the rod below the items for inhibiting downward movement of an item supported on the rod, and a spring biasing means may be disposed on the rod in contact with the wall for urging items supported on the rod toward the rod free end.

In a more detailed sense, the wall may be formed of a peg board having a plurality of openings therein and the means for inhibiting movement of the items aligned outwardly from the rod free end, and the means for inhibiting lateral movement of an item supported on the rod, may comprise a plurality of formed wire members attached to the peg board.

In order to accommodate those displays which include a wall surface such as a peg board having a rod extending outwardly therefrom, a fixture is provided having means spaced from the rod end for inhibiting movement of no more than a predetermined number of the aligned items outwardly from the rod free end and means disposed along the length of the rod for inhibiting lateral movement of an item supported on the one rod.

BRIEF DESCRIPTION OF THE DRAWING

The foregoing and other features of the invention will be more particularly described in connection with the preferred embodiment and with reference to the accompanying drawing, wherein.

DESCRIPTION OF THE PREFERRED EMBODIMENT

Figure 1:
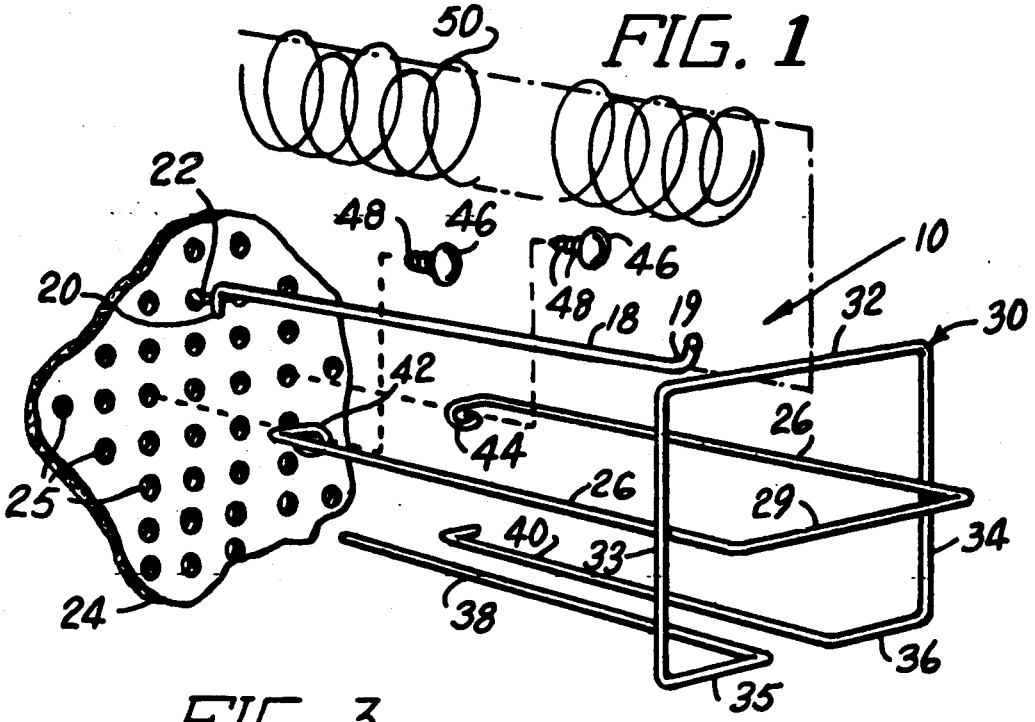
FIG. 1 is an elevational exploded perspective view showing the elements of an anti-pilferage device constructed in accordance with the teachings of the present invention.

For a more adequate understanding of the invention, reference should be had to the drawing wherein there is shown an anti-pilfering device 10 to be employed with a plurality of items 12 displayed in a row, as is common merchandising practice with items of the type shown. The items 12 generally comprise a product 14 which is contained in a shrink package, or bubble pack type packaging on a card 15, the card 15 having a plurality of holes 16 formed therein such that the item 12 may be supported from a rod, or arrangement of rods, for display purposes.

Figure 3:
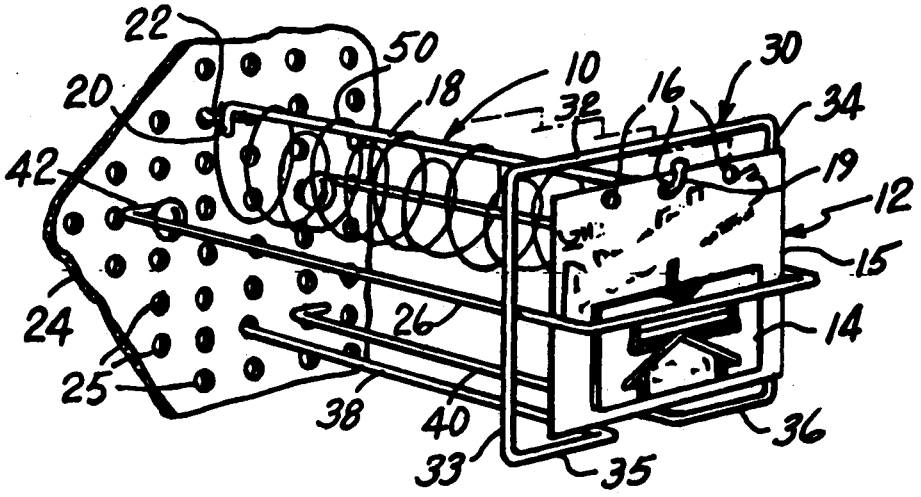
FIG. 3 is an elevational perspective view showing the structure of FIG. 1 and FIG. 2 in the assembled condition.

As best shown in FIG. 3, the single central opening 16 is received onto a single rod 18 having an upwardly directed portion 19 at its free end. At the opposite end of the rod 18, a downwardly projecting leg 20 is affixed to a U-shaped element 22 having a pair of upwardly directed free ends 23 one of which is visible in FIG. 2 of the drawing, the other being identical and lying behind the free end 23 shown.

The rod 18 is mounted on the wall surface of a peg board 24 having a plurality of holes 25 formed therein. In assembling the rod 18 to the peg board 24, the rod is tipped upwardly and the free ends 23 inserted through a pair of openings 25 in the peg board, such that when the rod is dropped to a position shown in FIG. 2, the free ends 23 lie behind the peg board 24 and the downwardly projecting leg 20 rests against the wall surface of the peg board to support the rod 18 substantially at right angles from the surface of the peg board.

The structure thus far described is similar to that employed in many stores and outlets, and from which products such as the items 12 are displayed. The items 12 are generally removed in any quantity desired by grasping the number of items and in one motion pulling them forwardly away from the surface of the peg board 24 and from the free end 19 of the rod 18.

In order to limit the number of items which may be removed from the rod 18 in a single gesture, or motion, the present invention provides an anti-pilferage fixture which is generally formed of a plurality of wire members bent to produce the desired configuration and/or welded or soldered for attachment one to the other to form the fixture. As best shown in FIG. 1, the fixture comprises a pair of elongated side members 26 and 28 which extend outwardly from the surface of the peg board 25 and are connected at the forward ends by a substantially horizontal front member 29. A substantially rectangular frame 30 is attached to the side members 26 and 28 at a predetermined location spaced rearwardly from the front member 29. The rectangular frame 30 comprises an upper arm 32, a pair of side arms 33 and 34, and a pair of lower arms 35 and 36 which form the bottom member of the rectangular frame.

The lower arms 35 and 36 each terminate substantially near the center of the rectangular frame 30 and are connected to a pair of bottom members 38 and 40 respectively, each extending rearwardly from the rectangular frame 30 toward the surface of the peg board 24. As is shown, the free end of the bottom member 38 is directed toward the peg board 24 while the free end of the bottom member 40 is bent at a right angle to the member 40 to lie parallel to the surface of the peg board 24.

Referring still to FIG. 1, it will be noted that the rearwardly extending ends of the side members 26 and 28 each are bent inwardly towards one another and substantially parallel to the surface of the peg board 24. A pair of loops 42 and 44 are formed at each free end of the side members 26 and 28 respectively, each forming an opening for receiving a headed fastener 46. The headed fastener 46 is provided with a plurality of outwardly projected protuberances 48 on its shank which are dimensioned for interference fit when extended through a respective opening 25 in the peg board 24.

Figure 2:
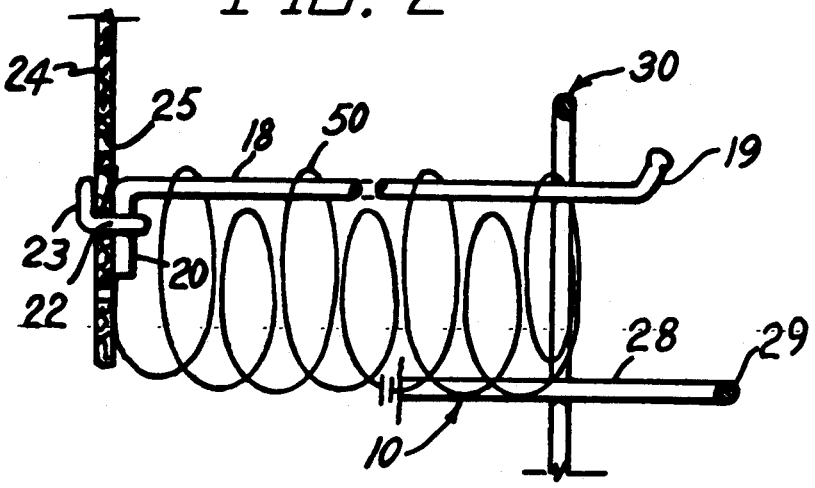
FIG. 2 is a side elevational view, partially in section, showing details of the assembly of the structure of FIG. 1.

Referring now to FIGS. 1 and 2, with the rod 18 mounted as previously described to the peg board 24, in order to accommodate the anti-pilferage fixture, a spring 50 is threaded along the rod 18 and has its free end inserted between the U-shaped element 22 and the peg board 24. The items 12 are attached to the rod 18 in alignment by inserting the free end of the rod through the center opening 16 in each of the cards 15, onto which the product 14 is mounted. With the items 12 in place, the fixture is held as shown in FIG. 1 and the headed fasteners 46 inserted through the loops 42 and 44. The loops 42 and 44 are aligned with a pair of openings 35 in the peg board 24 and the free end of the bottom member 38 has been formed such that it is also in alignment with another opening 25 in the peg board 24. The loops 42 and 44 are then placed in contact with the surface of the peg board and the fasteners 46 are forced through openings 25 to retain the fixture in place with the free end of the bottom member 38 extending through an opening 25 in the peg board 24, and the free end of the bottom member 40 resting on the surface of the peg board 24. As is shown in FIG. 3, taken in conjunction with FIG. 2, with the fixture so located, the upwardly directed portion 19 of the rod 18 extends beyond the rectangular frame 30 a predetermined distance as does the front member 29, to inhibit more than a predetermined number (for example one or two) of the items 12 to be moved forward of the rectangular frame 30 and rearwardly of the front member 29 which is the area permitting removal of the items from the upwardly directed portion 19 of the rod 18.

In operation, the anti-pilferage device 10 offers the plurality of items 12 in view of the customer and allows the customer to peruse the information contained on the card 15 and to examine the product 14 with relative ease. Should the customer desire to purchase an item, or in some cases a pair of items, depending on the area provided between the upwardly directed portion 19 of the rod 18 and the front member 29, the items are grasped and moved forwardly and upwardly from the space between the upwardly turned end 19 and the front member 29.

However, should a person desire to remove a great number, or all of the items 12 from the rod 18, it would require that he perform a number of separate removal operations requiring a length of time which would enhance the opportunity to be detected by store personnel, thus lessening the likelihood of pilferage. Additionally, due to the side members 26 and 28, and the bottom members 38 and 40, the items are inhibited from movement either in the lateral direction or in the downward direction should the person desire to force the items 12 from the rod 18 in the downward or sidewise direction by tearing the card 15 adjacent the opening 16.

Although it is apparent that changes and modification may be made within the spirit and scope of the present application, it is my intention, however, only to be limited by the appended claims. As my invention,

I claim:

1. An anti-pilferage fixture to be employed with at least one rod extending outwardly from a wall surface and terminating in a free end spaced from the wall surface for supporting a plurality of items disposed in a row on the rod for movement therealong, said fixture comprising:

means disposed along the length of the rod for inhibiting lateral movement of an item supported on the rod including a pair of elongated side members, one disposed on either side of the plurality of items, each said side member extending from the wall surface and being attached thereto; and means spaced from the rod free end for inhibiting movement of no more than a predetermined number of items outwardly from the rod free end including a front member disposed substantially parallel to the wall surface and connecting the outer ends of said side members, and a substantially rectangular frame attached to said side members, said front member being located a predetermined distance outwardly from the rod free end and said frame being located between the wall surface and the rod free end whereby items are removed from the rod free end within the predetermined distance between the rod free end and said front member.

2. An anti-pilferage fixture as set forth in claim 1 which further includes means disposed below the items supported along the length of the one rod for inhibiting downward movement of said item supported on the one rod.

3. An anti-pilferage fixture as set forth in claim 2 wherein said means for inhibiting downward movement of an item comprises a pair of elongated lower elements, each having an inner end contacting the wall surface and an outer end connected to said means for inhibiting movement of no more than a predetermined number of aligned items outwardly from the rod free end.

4. An anti-pilferage display device for use with a plurality of items to be displayed in row comprising wall means having at least one rod disposed therein with a free end extending therefrom for supporting the items in alignment for movement therealong towards said rod free end;

means disposed along the length of said rod for inhibiting lateral movement of an item supported on said rod including a pair of elongated side members having outer ends, one said side member disposed on either side of the plurality of items, each side member extending from said wall means and attached thereto; and means spaced from said rod free end for inhibiting movement of no more than a predetermined number of aligned items outwardly from said rod free end including a front member disposed substantially parallel to said wall means and connecting the outer ends of said side members, and a substantially rectangular frame attached to said side members, said front member being located a predetermined distance outwardly from said rod free end and said frame being located adjacent said rod free whereby said items are removed from said rod free end within the predetermined distance between said rod free end and said front member.

5. An anti-pilferage display device as set forth in claim 4 which further includes spring biasing means disposed on said one rod and in contact with said wall means for urging items supported on said one rod toward said rod free end.

6. An anti-pilferage display device as set forth in claim 4 which further includes means disposed below the items and extending along the length of said one rod for inhibiting downward movement of said item supported on said one rod.

7. An anti-pilferage device as set forth in claim 6 wherein said means for inhibiting downward movement of said item comprises a pair of elongated lower elements, each said elongated lower element having an inner end contacting said wall means and an outer end connected to said means for inhibiting movement of no more than a predetermined number of aligned items outwardly from said rod free end.

8. An anti-pilferage device as set forth in claim 4 wherein said one rod free end comprises a portion of said one rod bent upwardly whereby an item supported on said one rod is moved upwardly and outwardly from said rod free end when removed from said anti-pilferage display device.

9. An anti-pilferage fixture to be employed with at least one rod attached to a wall surface in the form of a peg board having a plurality of spaced openings formed therein, the rod terminating in a free end spaced from the wall surface and extending outwardly from the wall surface for supporting a plurality of items disposed in a row for movement along the rod, said fixture comprising:

means spaced from the rod free end for inhibiting movement of no more than a predetermined number of items outwardly from the rod free end;

means disposed along the length of the rod for inhibiting lateral movement of an item supported on the rod including a pair of elongated side members, one disposed on either side of the plurality of items, each said side member having one end terminating at the wall surface, each said one end having an opening formed therein and aligned with an opening in the wall surface; and a pair of headed fasteners, each having a shank formed with outwardly projecting protuberances dimensioned for interference fit when extended through a respective opening in the wall surface, each said headed fastener extending through a said opening in said side member end for attachment to the wall surface.

10. An anti-pilferage display device for use with a plurality of items to be displayed in a row comprising wall means having at least one rod disposed thereon with a free end extending therefrom for supporting the items in alignment for movement therealong toward said free end, whereby said wall means comprises a peg board having a plurality of spaced openings formed therein, said device further comprising:

means spaced from said rod free end for inhibiting movement of no more than a predetermined number of items outwardly from said rod free end;

means disposed along the length of said rod for inhibiting lateral movement of an items supported on said rod including a pair of elongated side members, one disposed on either side of the plurality of items, each said side member having one end having an opening formed therein and aligned with a said opening in said peg board; and a pair of headed fasteners, each having a shank formed with outwardly projecting protuberances dimensioned for interference fit with an opening in said peg board, each fastener being extended through a said opening in said side member end and a respective said opening in said peg board to retain said side members on said peg board.

11. An anti-pilferage fixture as set forth in claim 1 wherein each said elongated side member, said front member and said rectangular frame are comprised of formed wire material.

* * * * *